United States Patent [19]

Weisz

[11] 4,267,648

[45] May 19, 1981

[54] SHOE SOLE WITH LOW PROFILE INTEGRAL SPRING SYSTEM

[76] Inventor: Vera C. Weisz, 90 Pierce Rd., Watertown, Mass. 02172

[21] Appl. No.: 76,904

[22] Filed: Sep. 19, 1979

[51] Int. Cl.[3] ..... A43B 13/18; A43B 21/30

[52] U.S. Cl. ..... 36/28; 36/38

[58] Field of Search ..... 36/28, 38, 30 R, 38 R

[56] References Cited

U.S. PATENT DOCUMENTS

| | | | |
|---|---|---|---|
| 1,088,328 | 2/1914 | Cucinotta | 36/28 |
| 1,380,879 | 6/1921 | Young | 36/28 X |
| 2,437,227 | 3/1948 | Hall | 36/30 R |
| 2,668,374 | 2/1954 | Seigle | 36/28 |
| 3,429,545 | 2/1969 | Michel | 36/38 |

FOREIGN PATENT DOCUMENTS

| | | | |
|---|---|---|---|
| 223454 | 6/1956 | Australia | 36/28 |
| 281482 | 1/1931 | Italy | 36/28 |
| 646346 | 9/1962 | Italy | 36/28 |
| 585531 | 3/1977 | Switzerland | 36/28 |

*Primary Examiner*—James Kee Chi

*Attorney, Agent, or Firm*—Morse, Altman, Oates & Dacey

[57] ABSTRACT

Footwear is provided in which a low profile shock absorbing spring system is disposed within the bottom thereof. A plurality of individual shallow springs are mounted in spaced side-by-side relation within a chamber formed in the bottom of the shoe between a tread surface and an insole member.

5 Claims, 7 Drawing Figures

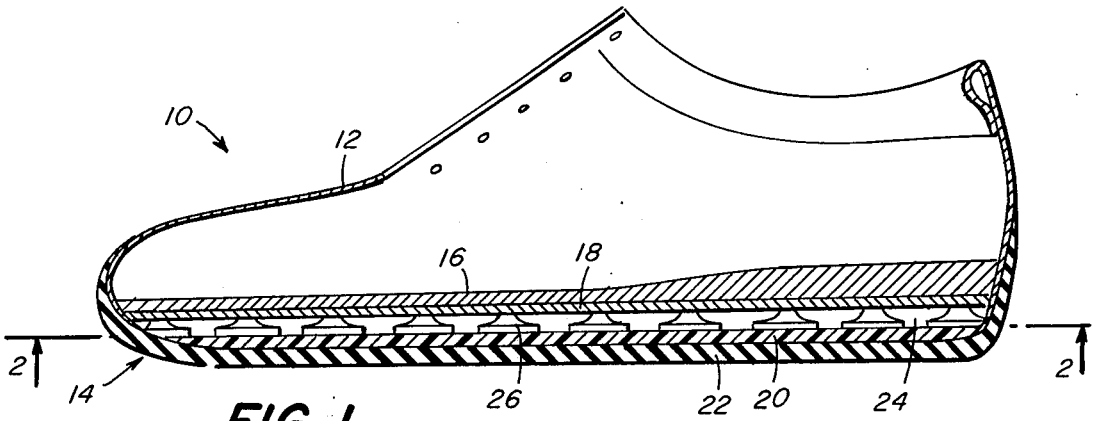
FIG. 1
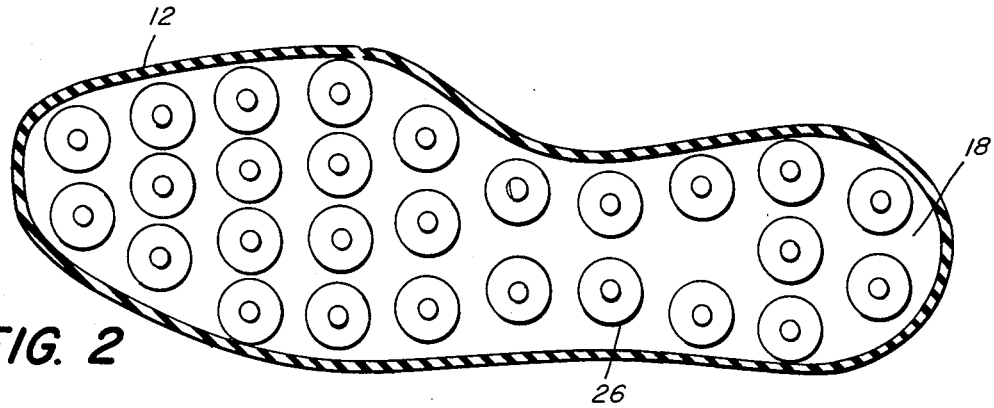
FIG. 2
FIG. 3
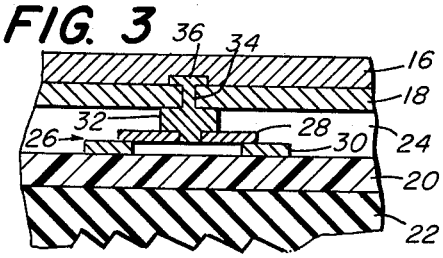
FIG. 5
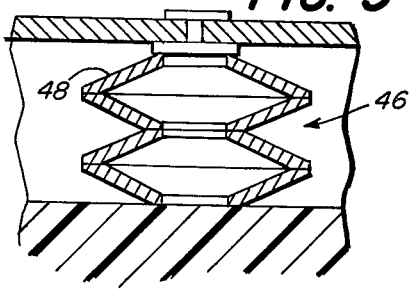
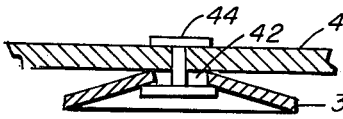
FIG. 4
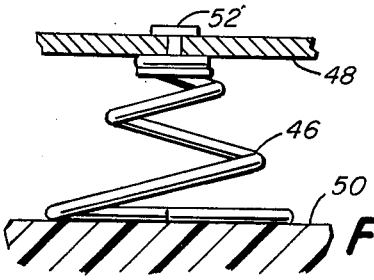
FIG. 6
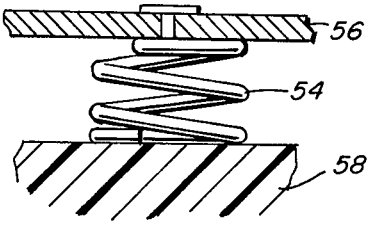
FIG. 7

SHOE SOLE WITH LOW PROFILE INTEGRAL SPRING SYSTEM

BACKGROUND OF THE INVENTION

1. Field of the Invention

This invention relates generally to footwear and more particularly is directed towards a new and improved article of footwear having an improved shock absorbing sole that is especially advantageous to joggers and the like.

2. Description of the Prior Art

Conventional footwear used by joggers and others is comprised of a relatively thin, soft upper and a resilient sole. The bottom of the footwear typically may comprise several layers of resilient material designed to provide a cushioning effect for the wearer which is desirable for those who use the footwear for jogging purposes. Typically the tread surface, which may be of a rubbery material and molded with a traction design, is bonded to a relatively light inner cushioning layer which may be of a foamed plastic or elastomeric material. While such types of footwear are in common use and do provide a sufficient measure of cushioning action for most runners, it has been found that conventional jogging shoes are inadequate for many potential runners, especially those affected with various types of persistent foot problems. While it is possible to increase the cushioning action of a shoe, sneaker or the like by providing thicker and softer soles and insoles, the resulting footwear becomes rather large and heavy as well as awkward to wear.

Accordingly, it is an object of the present invention to provide a new and improved article of footwear having improved cushioning characteristics and a relatively low profile.

Another object of this invention is to provide an article of footwear providing greater shock absorbing characteristics then conventional footwear.

SUMMARY OF THE INVENTION

This invention features an article of footwear, comprising an upper portion and a bottom portion connected to one another in the form of a shoe, sneaker or similar article of footwear. The bottom portion of the footwear is characterized by upper and lower insole members coextensive with one another and spaced apart to define a shallow chamber therebetween. A plurality of low profile spring elements are mounted in the chamber in spaced relation to one another between the upper and lower insole members to provide a resilient spring action when the shoe is worn.

BRIEF DESCRIPTIONS OF THE DRAWINGS

FIG. 1 is a sectional view in side elevation of an article of footwear made according to the invention, FIG. 2 is a cross-sectional view taken along the line 2—2 of FIG. 1, FIG. 3 is a detailed sectional view on an enlarged scale of a spring element employed in the invention, FIG. 4 is a view similar to FIG. 3 but showing a modified spring element, FIG. 5 is a view similar to FIG. 3 and showing another modification of the invention, FIG. 6 is a view similar to FIG. 3 showing still another modification of the invention, and, FIG. 7 is a view similar to FIG. 3 showing still another modification of the invention.

DETAILED DESCRIPTION OF THE PREFERRED EMBODIMENT

Referring now to the drawings and to FIGS. 1 through 3 in particular, the reference character 10 generally indicates an article of footwear having the outer appearance of a sneaker, jogging shoe, or the like, and comprised of an upper 12 and a bottom 14. The upper 12 may be fabricated from a variety of different materials commonly used in footwear and may be from various types of fabric as well as leather, both real and artificial, plastics and combinations thereof.

The bottom 14, as best shown in FIG. 1, is comprised of an insole 16 extending the full length and width of the shoe and coextensive with plate 18 of a semi-flexible material which may be a thin, spring steel sheet, semi-rigid plastic, or the like. The insole 16 is made out of common insole material such as leather, plastic, natural fibrous materials, compositions or the like. The insole 16 and the plate 18 comprise the upper portion of the bottom 14 and are spaced apart from the lower portion of the bottom which is comprised of a stratum 20 of a relatively firm, but resilient material and a stratum 22 of a relatively tough, long wearing resilient material such as rubber or other elastomeric material and providing a tread surface for the shoe. The bottom face of the tread stratum 22 may be molded with a three dimensional design in order to enchance traction of the shoe. In practice, the stratum 20, may be made of a material known in the trade as "fluff" and which is a relatively stiff and somewhat flexible foamed material having a fibrous texture, light weight and resilient characteristics.

The plate 18 and stratum 20 are separated from one another to form a shallow chamber 24 coextensive with the width and length of the shoe insole. The chamber serves to accommodate a plurality of spring elements 26 mounted in closely spaced relation within the chamber 24 and attached at their upper ends to the plate 18. The lower ends of each spring bear against the top surface of the stratum 20 in the manner shown.

In practice, the springs 26 are arranged in transverse rows, the number of the springs in each row being determined by the width of the shoe at different points along the length thereof. Thus, at the widest point of the shoe the greatest number of springs will be present in a row extending across that portion. The spring elements should be relatively close to one another at the forward portion of the shoe insofar as, under normal circumstances, most persons who are jogging will run so that most of their weight will come down against the ball of the foot. Across the instep the spring elements may be more widely spaced whereas at the heel it is desirable that they become more closely packed since some persons tend to come down heavily on the heel.

In the preferred form of the invention the spring element 26 is in the form of a disc spring. Disc springs are preferred for the reasons that relatively large forces are present and working on the spring elements and space is at a premium, particularly in the vertical direction. Disc springs consist essentially of a disc or washer 28 supported at its outer periphery by means of an annular support 30. The opposing forces are transmitted through a hub 32 mounted to the center of the disc 28. The support 30 provides clearance in the center for the disc 28 to deflect under applied force from the weight of the wearer coming down in an essentially vertical direction against the hub 32. The hub 32 is secured in fixed position to the plate 18 by means of a reduced neck 34 passing through the plate 18 with the upper end thereof terminating in a relatively flat and enlarged head 36 which may be formed by upsetting techniques or the like. Other fastening techniques such as riveting, cementing, welding and the like may also be used to secure the hub in position to the plate 18. Typically, the disc spring 28 tapers somewhat towards its center so that the periphery is somewhat thicker than the center portion thereof. This type of spring element provides a very low profile so as not to cause a significant increase in the thickness of the shoe bottom as compared to conventional shoe bottoms that rely on conventional cushioning materials.

The spring elements may be made up in a variety of different sizes but, in practice, it is desirable to have a number of relatively small spring elements distributed over the shoe in a pattern such as that shown in FIG. 2. By utilizing a relatively large number of small springs, a more even distribution of stable spring action is achieved.

While the disc spring of the sort shown in FIG. 3 is particularly desirable because of its relatively short stroke and resistance to lateral displacement and as well as its small space needs, other types of springs may also be used. For example, in FIG. 4 there is illustrated a Belleville spring 38 attached to the under side of a plate 40 similar to the plate 18 of the principal embodiment. The spring 38 is in the form of a somewhat flat and hollow truncated cone having an opening 42 through the center thereof. The spring is held in place by means of a fastener 44 such as that shown although other fastening devices may also be employed. In order to ensure proper operation of the spring 38, the lower edge of the spring should bear against a hard support which may be in the form of a thin metal or hard plastic plate.

In FIG. 5 there is illustrated a compound Belleville spring 46 in which a plurality of individual Belleville spring elements 48 are stacked one to another. This configuration provides for greater deflection of the spring assembly and the forces are transmitted from one to another by means of inner and outer collars. Again, a relatively hard support should be provided at the top and bottom of the spring assembly.

Referring now to FIG. 6 of the drawings, there is illustrated another type of spring that may be used in the shoe and, in this embodiment, a spiral spring 46 is mounted between a plate 48 and mid-sole stratum 50. The spring 46 is in the form of a spiral helix which provides stability by the spring having a wide base and a narrow upper portion. The upper portion is secured by a fastener 52 to the plate 48 while the wider base portion rests against the stratum 50. The spiral helix configuration of the spring provides a relatively long stroke in that the upper convolutions are able to nest into the lower convolutions when the spring is compressed.

In the FIG. 7 embodiment, a helical spring 54 is mounted between a plate 56 and a stratum 58. The spring 54 is of course, designed to be put into compression when a vertical force is applied thereto.

Shoes made according to the invention provide greater shock absorbing capability than conventinal shoes thereby making it more comfortable for joggers and the like, especially those afflicted with various types of foot problems. The spring system provides a stronger return action than conventional cushioning material without a significant increase in size, weight or thickness of the shoe.

While the invention has been described with particular reference to the illustrated embodiments, numerous modifications thereto will appear to those skilled in the art. For example while the footwear has been described in conjunction primarily with a conventional shoe upper, the bottom portion may be used with other types of footwear such as sandles, boots, hiking shoes, street shoes and the like. Also, various types of other spring devices may be used to advantage in place of the spring elements illustrated.

Having thus described the invention, what I claim and desire to obtain by Letters Patent of the United States is:

1. An article of footwear, comprising (a) an upper portion for engaging the top of a foot on which said footwear is worn, (b) a bottom portion connected to said upper portion for engaging the sole of said foot, (c) said bottom portion including at least a pair of upper and lower strata generally conforming to the outline of said sole and spaced from one another to define a chamber therebetween, and, (d) spring means of relatively low profile mounted in said chamber and adapted to provide a spring action perpendicular to said sole, (e) spring means including a plurality of individual spring units arranged in closely spaced side by side relation within said chamber, (f) each of said spring units comprised of a relatively wide annular support mounted to one of said strata, a hub mounted to the other of said strata in opposing coaxial relation to said support and a relatively narrow disc spring element mounted coaxially to said hub and engaging said support, said support providing axial clearance for said disc when the center thereof is deflected axially by applied force.

2. An article according to claim 1 wherein said upper stratum is of a relatively hard, stiff material and said lower stratum is of a material that is softer and more flexible than said upper stratum material.

3. An article according to claim 2 wherein said upper stratum material is metal.

4. An article according to claim 1 wherein said bottom portion includes a tread stratum and a cushion stratum below said chamber and a metal plate and an insole above said chamber.

5. An article according to claim 1 wherein said disc spring element is formed with a peripheral portion that is thicker than the central portion thereof, said element being tapered from the periphery to the center thereof.

* * * * *